United States Patent [19]

Miyazaki

[11] 4,367,617

[45] Jan. 11, 1983

[54] GUIDE DEVICE FOR GUIDING WRAPPING PAPER IN COIN WRAPPING MACHINE

[75] Inventor: Yorizo Miyazaki, Tokyo, Japan

[73] Assignee: Laurel Bank Machine Co., Ltd., Tokyo, Japan

[21] Appl. No.: 242,328

[22] Filed: Mar. 10, 1981

[30] Foreign Application Priority Data

Apr. 2, 1980 [JP] Japan ..... 55-44281[U]

[51] Int. Cl.[3] ..... B65B 11/04

[52] U.S. Cl. ..... 53/212

[58] Field of Search ..... 53/211, 212; 226/198, 226/199

[56] References Cited

U.S. PATENT DOCUMENTS

| | | | |
|---|---|---|---|
| 793,413 | 6/1905 | Broga | 53/212 |
| 3,740,923 | 6/1973 | Itoda | 53/212 |
| 3,798,873 | 3/1976 | Frahm | 53/212 |
| 3,899,864 | 8/1975 | Uchida | 53/212 |
| 4,049,011 | 9/1977 | Nakai | 53/212 |

*Primary Examiner*—John Sipos

*Attorney, Agent, or Firm*—Fleit & Jacobson

[57] ABSTRACT

There is provided an improved guide device for use in a coin wrapping machine. The device comprises a main guide plate and a subsidiary guide plate movably mounted on the main guide plate to be moved at the extended position at which the guide edge of the subsidiary guide plate projects in front of the guide edge of the main guide plate to guide the web of wrapping sheet when a coin column of larger diameter is handled in the wrapping machine. The subsidiary guide plate is moved to the retracted position when a coin column of smaller diameter is handled in the coin wrapping machine. The subsidiary guide plate may be urged to take the normally extended position under the action of a spring and may be automatically retracted for service to guide the web of wrapping sheet when a coin column of larger diameter is handled by the provision of abutting members. According to the present invention, coin columns of various diameters can be wrapped tightly by the web of wrapping sheet which is guided reliably and precisely by the guide edge of the subsidiary guide plate.

3 Claims, 5 Drawing Figures

GUIDE DEVICE FOR GUIDING WRAPPING PAPER IN COIN WRAPPING MACHINE

BACKGROUND OF THE INVENTION

1. Field of the Invention:

The present invention relates to a coin wrapping machine, and more particularly to a guide device for facilitating smooth guide of wrapping paper when the wrapping paper is wrapped around an accumulated column of coins.

In a coin wrapping machine, a pre-set number of coins is stacked to form a column of coins and then a sheet of wrapping paper or other wrapping sheet, such as plastic sheet, is wrapped around the outer periphery of the coin column. The wrapping sheet is fed in a form of continuous web having a width larger than the height of the accumulated column of coins, so that marginal cylindrical portions formed of the wrapping sheet extend beyond the upper and lower end faces of the coin column. These extending cylindrical portions are then crimped and caulked to obtain a wrapped coin column. Generally, several species of coins are handled in the same coin wrapping machine. Therefore, the coin wrapping machine shall be adapted to handle a variety of coin species. The present invention is directed to a device for guiding a web of wrapping sheet smoothly in wrapping operation whatever species of coins are handled to be wrapped by the machine.

2. Prior Art:

A typical coin wrapping machine known in the art is shown in FIG. 1, wherein three wrapper rollers 1, 2 and 3 are provided and rotated by driving means, not shown. The ends of the rollers 1, 2 and 3 are rotatably carried by carrier links 4, 5 and 6, respectively, and these carrier links can be swung to allow the wrapping rollers 1, 2 and 3 to engage with or disengage from the outer peripheral portions of the coin column a. It should be noted here that another similar set of carrier links carries the lower ends of the wrapping rollers 1, 2 and 3 although only the upper set of carrier links 4, 5 and 6 is shown in the Figure for clarity. A guide plate 7 for guiding the leading end of the web of wrapping sheet along the periphery of the coin column a is rotatably mounted to one of the rollers, for example the roller 1 as shown. Attached to the guide plate 7 is an arm 8 which is pivoted to one end of a link arm 9. The other end of the link arm 9 is connected via a rod to another link arm 10' which carries a bar having the free end provided with a crimping claw 10. The link arm 10' can be pivoted about a shaft 11 to position the crimping claw 10 over or out of the coin column a clamped by the wrapping rollers 1, 2 and 3. When the bar carrying the crimping claw 10 is desired to move to the operating position, the guide plate 7 must be retracted to the position at which the guide plate 7 is out of the sheet guiding position. For this purpose, the arm 8 is swung through the link arm 9 to put the guide plate 7 out of the way of the moving pawl 10. Reference numeral 13 designates a support cylinder for receiving and holding the coin column a from an accumulator tube, not shown. The coin column a is lowered to the position surrounded by the wrapping rollers 1, 2 and 3 while being held by the support cylinder 13, and then engaged with three rollers at a position centrally of the latter. The wrapping rollers are then rotated to rotate the coin column and to wrap the wrapping sheet around the coin column.

In the aforementioned wrapping machine of prior art technology, the shape and size of the sheet guide plate 7 is designed such that it can be positioned to handle the smallest coins. This is because the guide edge of the plate 7 tends to contact with the periphery of another roller, for example roller 2, when a coin column of larger diameter is handled, if the shape and size thereof is designed to accommodate to the coin column of larger diameter. As a result, when a coin column of larger diameter is handled by the prior art device of the aforementioned type, a gap of appreciable dimensions (for instance, as denoted by b in FIG. 5) is formed between the guide edge of the plate 7 and the periphery of the coin column. The leading end of the web of wrapping sheet extending over this gap is not guided by any member in operation of the prior art device, so that the leading end of the web tends to be mis-led so as to be deviated from the designed vertical position to result in a helically wrapped condition or tends to be folded, which at a later time would cause slack in the wrapping sheet wound around the coin column. The tendency of forming the helically wrapped cylinder of wrapping sheet, as aforementioned, is particularly disadvantageous in that the marginal ends of the cylinder of wrapping sheet projecting beyond the ends of the coin column bring a considerable difficulty in the subsequent crimping operation.

SUMMARY AND OBJECT OF THE INVENTION

The object of the present invention is to eliminate the aforementioned disadvantage of the prior art coin wrapping machine.

The aforementioned object of the invention is attained by the provision of a subsidiary guide plate movably attached to the main guide plate to be moved to the position extending or projecting in front of the guide edge of the main guide plate to guide the leading end of the web of the wrapping sheet when a coin column of larger diameter is handled and to the retracted position when a coin column of smaller diameter is handled. The subsidiary guide plate may be urged to project forward by suitable means, such as a bias spring, and may be provided with an abutting member to abut against one of the wrapping rollers or one of the carrier members for the wrapping rollers to bring the subsidiary guide plate to the retracted position. The abutting member may be a roller rotatably mounted on the forward end of the subsidiary guide plate.

DESCRIPTION OF THE DRAWINGS

The above and other objects and advantages of the present invention will become apparent from the following detailed description of the preferred embodiment with reference to the accompanying drawings, in which.

DESCRIPTION OF THE PREFERRED EMBODIMENT

The present invention will now be described in detail with reference to the appended drawings.

Figure 1:
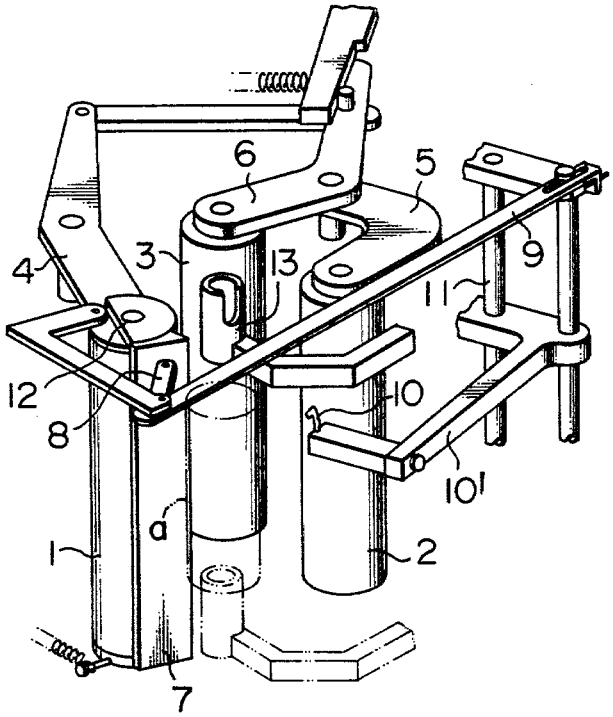
FIG. 1 PRIOR ART
FIG. 1 is a perspective view showing, in somewhat diagrammatical manner, important parts of a prior art coin wrapping device.
Figure 2:
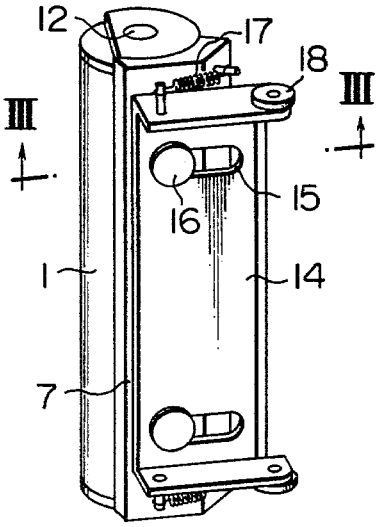
FIG. 2 is a perspective view of a coin wrapping roller provided with a guide plate and a subsidiary guide plate according to the present invention.
Figure 3:
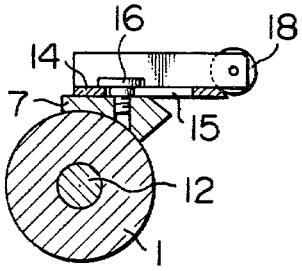
FIG. 3 is a sectional view taken on line III—III in FIG. 2.

Firstly referring to FIGS. 2 and 3, a main guide plate 7 is attached to a coin wrapping roller 1 and a subsidiary guide plate 14 is mounted on the main guide plate 7 in overlapping relationship with each other. The subsidiary guide plate 14 is formed with a pair of parallel elongated through-holes 15 extending generally in the horizontal direction in the illustrated embodiment. Pins projecting from the contacting face of the main guide plate 7 are received in respective through-holes 15 and have heads 16 for preventing the pins from pulling out of the through-holes 15. The subsidiary guide plate 14 can slide in the horizontal direction and is normally urged to be at the foremost position by the action of tension springs 17 so that the guide edge of the subsidiary guide plate 14 projects beyond the guide edge of the main guide plate 7, as shown in FIG. 2. An abutting roller 18 is rotatably pivoted at the forward end of a collar of the subsidiary guide plate 14. However, this abutting roller 18 may be dispensed with and the forward end of the collar may be simply rounded to abut against the periphery of another roller.

Figure 4:
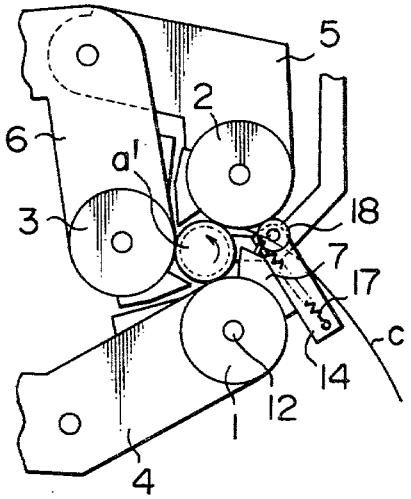
FIG. 4 is a diagrammatical plan view of the device of the present invention and showing the operation of handling the smallest coins.
Figure 5:
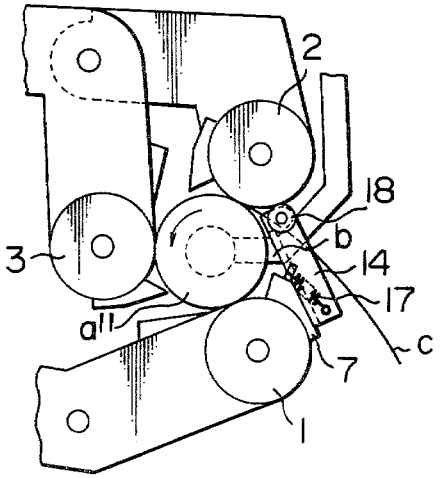
FIG. 5 is a view similar to FIG. 4, but showing the operation of handling a coin column of larger diameter.

In operation of wrapping a coin column of smaller diameter a′, as shown in FIG. 4, the coin column of smaller diameter a′ is clamped by three rollers 1, 2 and 3 and the abutting roller 18 abuts against the wrapping roller 2 or the end of the carrier link 5 to retract the subsidiary guide plate 14. Under this condition, the leading end of the web of wrapping sheet is guided by the guide edge of the subsidiary guide plate 14 which is substantially aligned with the guide edge of the main guide plate 7. On the other hand, when a coin column of larger diameter coins a″ is handled, the subsidiary guide plate 14 is extended and the guide edge thereof is positioned beyond the guide edge of the main guide plate 7, as shown in FIG. 5, by the action of the tension springs 17. As a result, the leading end of the web can be reliably guided over the gap b to the nip formed between the rollers 2 and the coin column. The web of wrapping sheet c is then wrapped around the coin column smoothly and tightly, upon rotation thereof in the direction denoted by the arrows in FIGS. 4 and 5 irrespective of the diameter of the coins.

After completion of wrapping operation, the main guide plate 7 is swung about the axis 12 together with the subsidiary guide plate 14 held at the extended position so as not to hinder the movement of the link arm 10′ carrying the crimping claw 10 by actuating the linking mechanism including the arm 8 and the link arm 9.

As will be apparent from the foregoing, according to the present invention, the leading end of the web of wrapping sheet can be always guided reliably and precisely by the provision of a movable subsidiary guide plate. It will be also apparent to those skilled in the art that various modifications and changes may be made in the present invention without departing from the spirit and scope thereof. Accordingly, the foregoing description is not construed as a limiting sense but shall be construed as illustrative only.

What is claimed is:

1. A coin wrapping machine for wrapping coins with a web of wrapping sheet, the machine having coin wrapping rollers which are adapted to move toward each other to take a first position where the coin wrapping rollers are engaged with the coins for a wrapping operation and to move away from each other to take a second position where the coin wrapping rollers are retracted, said machine further comprising:

a main guide plate mounted on one of the coin wrapping rollers for rotation about the axis thereof;

a subsidiary guide plate slidably mounted on the main guide plate for guiding said web between said wrapping rollers and coins; and biassing means for biassing the subsidiary guide plate to project toward another one of the coin wrapping rollers when the coin wrapping rollers take the first position, said subsidiary guide plate being provided with at least one abutting roller to abut against the periphery of the another one of the coin wrapping rollers when the coin wrapping rollers take the first position.

2. A machine as set forth in claim 1, wherein one of the main guide plate and the subsidiary guide plate is provided with at least one elongated opening and the other is provided with at least one pin adapted to extend through the elongated opening, said opening and said pin cooperating with each other to permit said main guide plate and said subsidiary guide plate to slidably move relative to each other.

3. A machine as set forth in claim 1 or 2, wherein said coin wrapping rollers are movable into a plurality of first positions corresponding to different diameters of coins being wrapped, said subsidiary guide plate being retracted by engagement between the abutting roller and the periphery of the another one of the coin wrapping rollers when said coin wrapping rollers are in a first position for wrapping small diameter coins.

* * * * *